US006038824A

United States Patent [19]

Hamrick, Sr.

[11] Patent Number: 6,038,824

[45] Date of Patent: Mar. 21, 2000

[54] NONCOMBUSTIBLE TRANSPORTABLE BUILDING

[76] Inventor: William T. Hamrick, Sr., 525 Bates Rd., Haines City, Fla. 33844

[21] Appl. No.: 09/042,748

[22] Filed: Mar. 17, 1998

[51] Int. Cl.[7] ..... E04B 1/34

[52] U.S. Cl. ..... 52/143; 52/79.1; 52/125.2; 52/125.6; 52/481.1

[58] Field of Search ..... 52/79.1, 79.7, 52/79.8, 79.9, 125.2, 125.3, 125.6, 143, 348, 481.1

[56] References Cited

U.S. PATENT DOCUMENTS

| | | | |
|---|---|---|---|
| 2,391,960 | 6/1946 | Gede, Jr. | 52/348 |
| 3,382,625 | 5/1968 | Kuss | 52/125.2 X |
| 3,683,571 | 8/1972 | Walz, Jr. et al. | 52/125.2 |
| 4,644,708 | 2/1987 | Baudot et al. | 52/79.7 X |
| 4,807,407 | 2/1989 | Horn | 52/79.1 |
| 4,833,841 | 5/1989 | Ellington, III | 52/79.1 |
| 5,113,625 | 5/1992 | Davis | 52/143 |
| 5,417,023 | 5/1995 | Mandish | 52/348 |
| 5,647,180 | 7/1997 | Billings et al. | 52/348 X |
| 5,845,441 | 12/1998 | Swartz | 52/79.1 X |

*Primary Examiner*—Carl D. Friedman
*Assistant Examiner*—Timothy B. Kang
*Attorney, Agent, or Firm*—Holland & Knight LLP

[57] ABSTRACT

A noncombustible transportable building has a floor structure that includes a floor frame constructed of steel members. A concrete floor is disposed within the steel floor frame. Steel wall studs are welded to the floor frame to form the wall frame for the building. In addition, a steel roof frame, constructed of steel roof studs, is welded to the wall frames for supporting a roof and ceiling. Polystyrene foam insulation is secured to the roof frame and wall frames, between consecutive wall and roof studs. A cement mixture is applied to both the interior and exterior of the building along the four outer walls, the roof and ceiling. A steel mesh is secured to the exterior and interior of the building along the roof and walls. A lifting frame including four vertical columns mounted to the frame positioned at points on the frame to evenly distribute the weight of the building as it is lifted or lowered. Cross members and diagonal members extend intermediate the columns to support the columns for lifting. A lifting eye, for attachment of a crane to the building, is mounted to a top end of each of the columns.

8 Claims, 9 Drawing Sheets

NONCOMBUSTIBLE TRANSPORTABLE BUILDING

FIELD OF THE INVENTION

This invention pertains those prefabricated buildings that are manufactured and assembled off site, then transported to a construction site, where the building may serve as a stand alone building, or as a module for construction of a larger building. More specifically, this invention, pertains to such transportable buildings constructed of steel frame members and other noncombustible materials.

BACKGROUND OF THE INVENTION

Transportable buildings in various forms are known in the art of building construction. In some instances, panels are constructed or manufactured, and shipped to a construction site where the building is assembled. Other buildings are completely constructed and then transported to a construction site where the building is secured to a foundation.

Many modular buildings are constructed of wooden construction materials that are highly flammable. According to many building codes, some buildings may be required, or chosen, to be constructed of noncombustible building materials. Noncombustible buildings may be classified as a Type IV building according to adopted building codes known in the industry. Transportable buildings have been constructed of noncombustible material to overcome this inherent trait of wooden construction materials.

Building materials used for this construction include steel frame and support members and concrete. As a result, the buildings are extremely heavy and awkward to handle for lifting and lowering for transportation. In addition, these buildings are designed to survive extreme ambient conditions including high winds or collisions from projectiles in hurricane or tornado conditions.

SUMMARY OF THE INVENTION

Accordingly, in view of the foregoing, it is an object of the present invention to provide a noncombustible and transportable building that is structurally sound. Another object of this invention is to incorporate the interior and exterior surface of the building as a structural component of the building enhancing the overall structural integrity of the building.

Yet another objective of the invention is to provide this invention with means for hitching the building to a lifting means for transportation, wherein the hitching means is incorporated in the frame structure of the building. Still another object of this invention is to provide a building that is adaptable for use as a module for a larger building.

These and other objectives are achieved by providing a transportable building with a steel frame work. The floor structure of the building includes a floor frame constructed of steel members. A corrugated decking is disposed within the steel floor frame, and a concrete floor is poured over the decking and within the floor frame. Steel wall studs are welded to the floor frame to form the wall frame for the building. In addition, a steel roof frame, constructed of steel roof studs, is welded to the wall frames for supporting a roof and ceiling. Polystyrene foam insulation is secured to the roof frame and wall frames, between consecutive wall and roof studs.

A cement mixture is applied to both the interior and exterior of the building along the four outer walls, the roof and ceiling. A steel mesh is secured to the exterior and interior of the building along the roof and walls. The cement mixture is then applied to the mesh securing the cement as a wall covering against the building frame. The cement covering, in conjunction with the mesh, enhances the overall structural integrity of the building.

A means for hitching the building to a lifting means is incorporated into the building frame by welding the same to the floor frame, the wall frame and the roof frame. The hitching means extends generally vertically from the floor structure of the building, and extends through the roof of the building for engagement with a crane. The hitching means includes a lifting frame including four vertical columns mounted to the frame positioned at points on the frame to evenly distribute the weight of the building as it is lifted or lowered. Cross members and diagonal members extend intermediate the columns to support the columns for lifting. A lifting eye, for attachment of a crane to the building, is mounted to a top end of each of the columns.

In one embodiment of the invention, the transportable building is constructed of modules. In this embodiment each of the modules incorporates a lifting frame; however, two of the vertical columns are removable along the junction of the modules. The modules are constructed off site at the manufacturing facility with the lifting frame. After the modules are transported to the construction site and placed on the appropriate foundation and joined together, the columns are removed. The interior and exterior of the building is then finished according to building specifications.

DETAILED DESCRIPTION OF THE DRAWINGS

Figure 1:
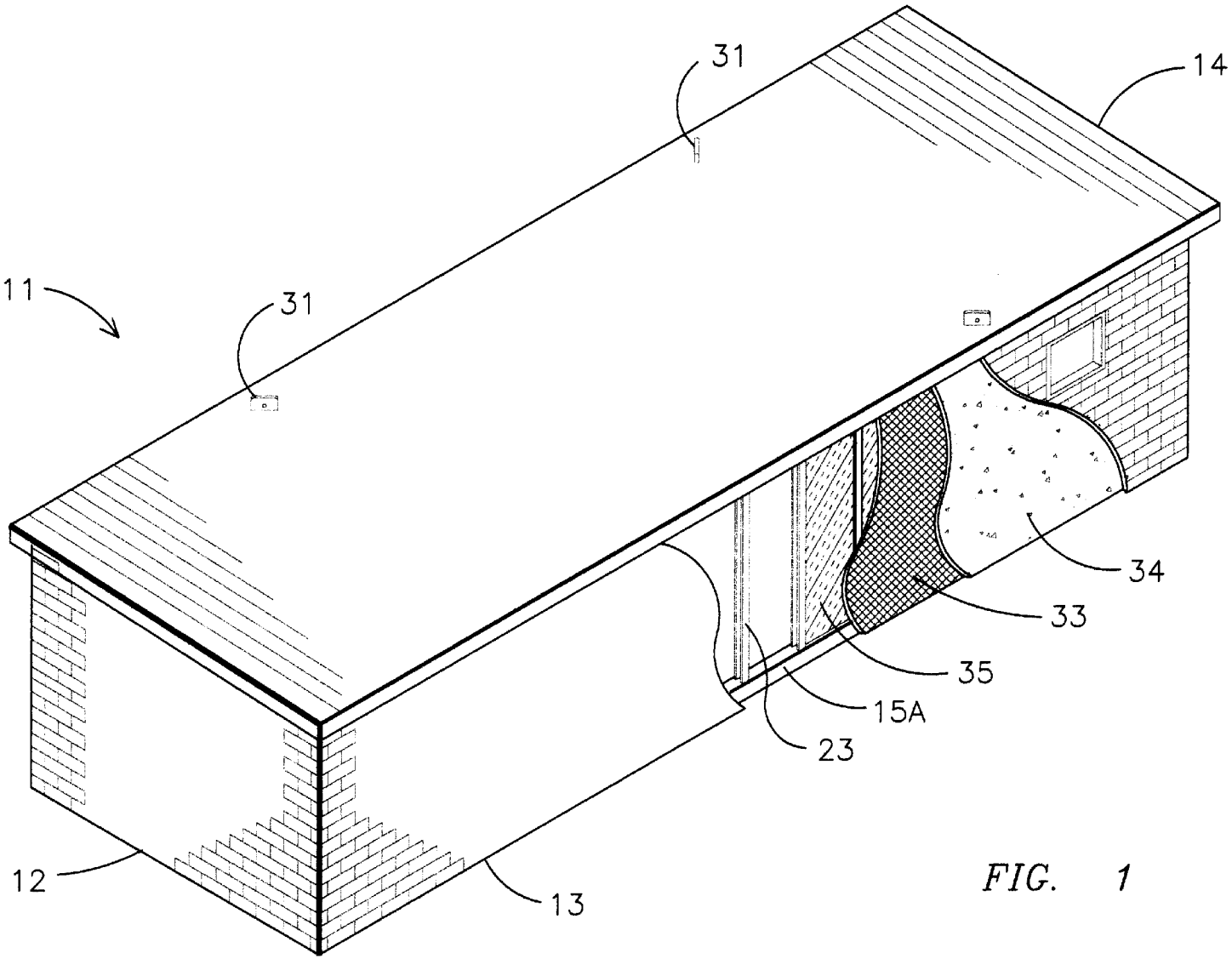
FIG. 1 is a perspective view of a first embodiment of a non-combustible transportable building.

A first embodiment of the noncombustible transportable building 11 is generally illustrated in FIG. 1. This building includes two end walls 12 and two side walls 13. A roof 14 is mounted to the side walls 13 and end walls 12 forming the enclosed building. Windows, doors, interior walls, plumbing and electrical work are provided according to the specifications of the building. The frame of the building is preferably constructed of steel frames members welded together, and includes a floor frame 15, wall frames 16 and a roof frame 17.

Figure 2:
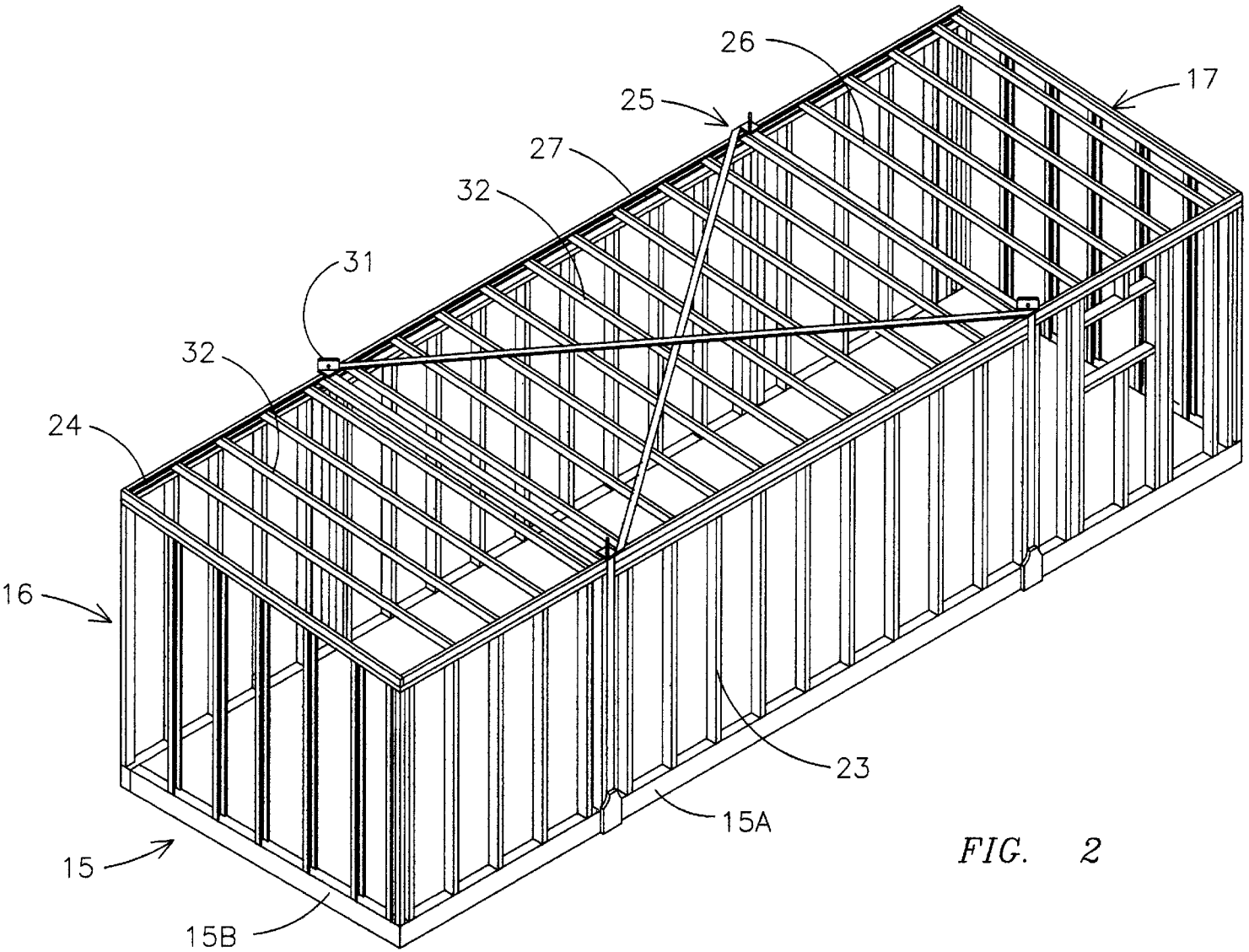
FIG. 2 is a perspective view of the wall frame, roof frame with the lifting frame of the building shown in FIG. 1.
Figure 6:
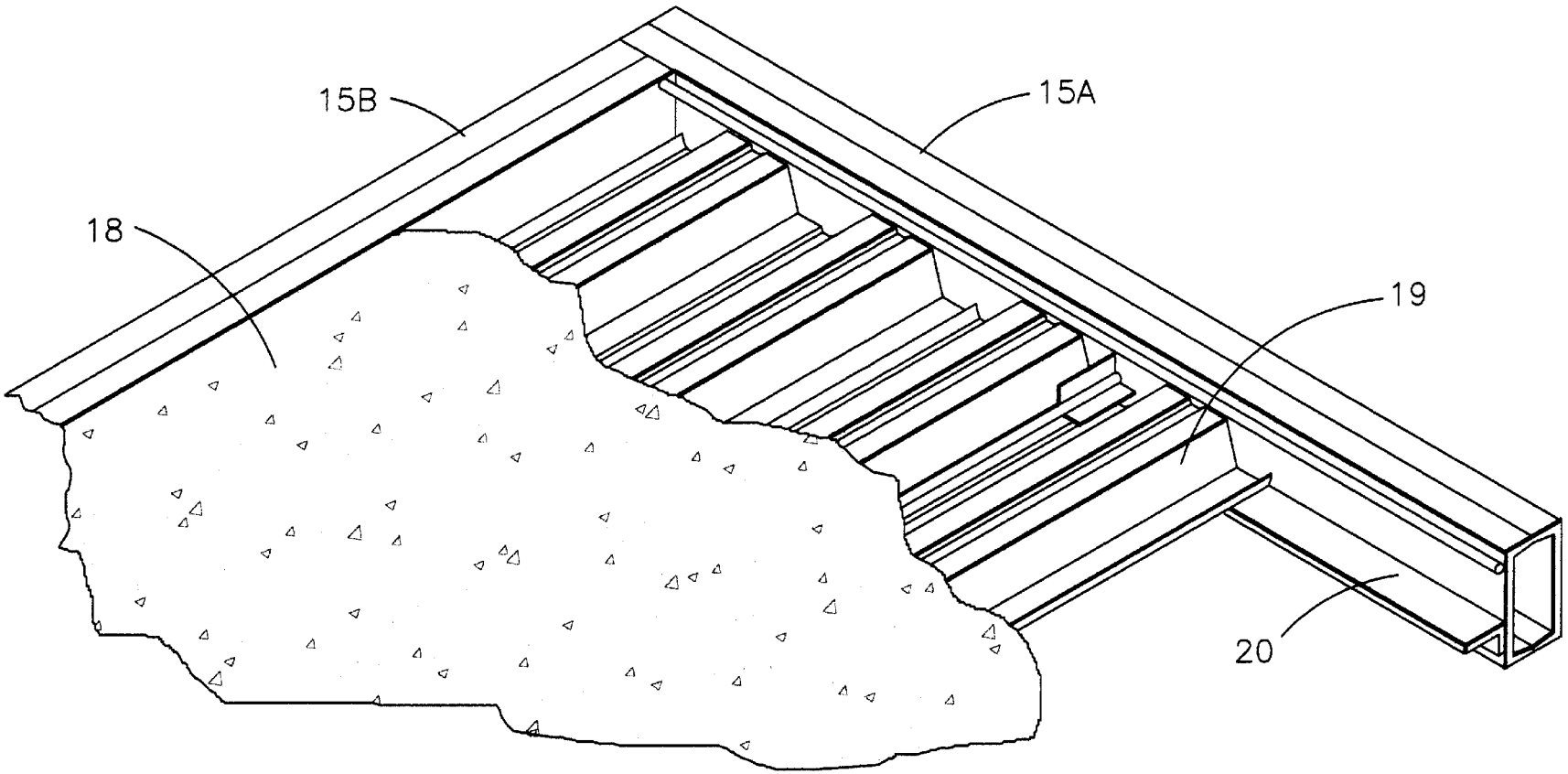
FIG. 6 is an expanded view of a corner of the floor structure of the noncombustible transportable building.
Figure 7:
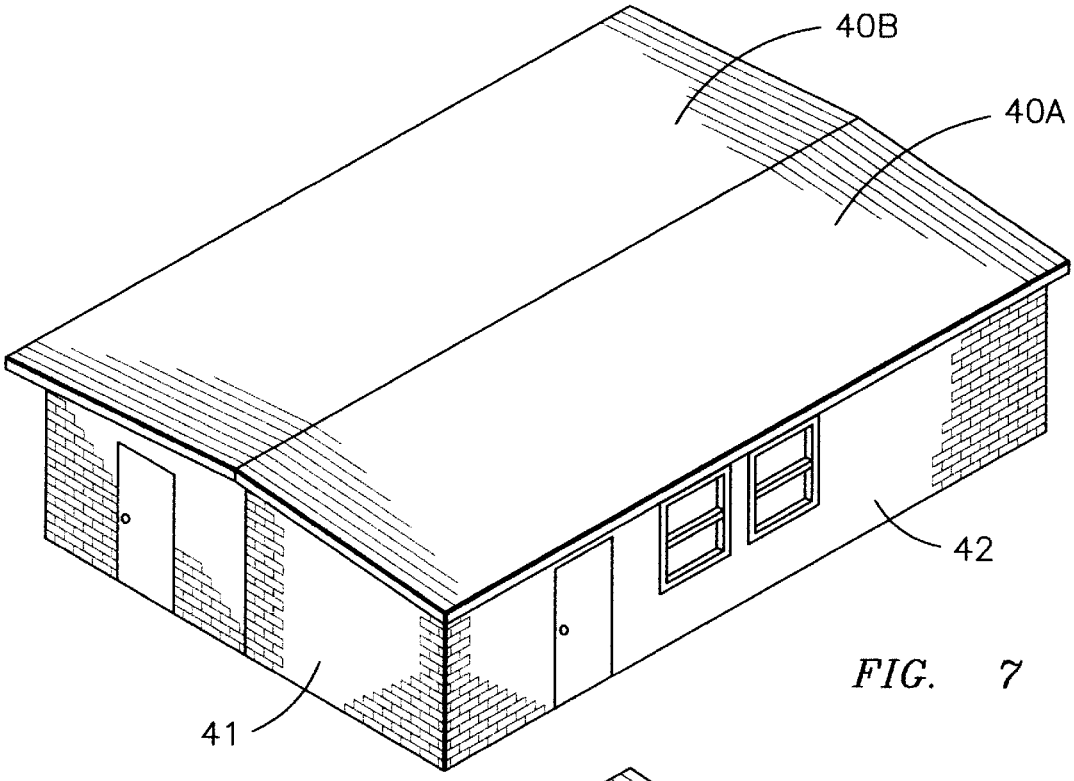
FIG. 7 is a perspective view of the two modular sections adjoined together to form a single modular building.
Figure 8:
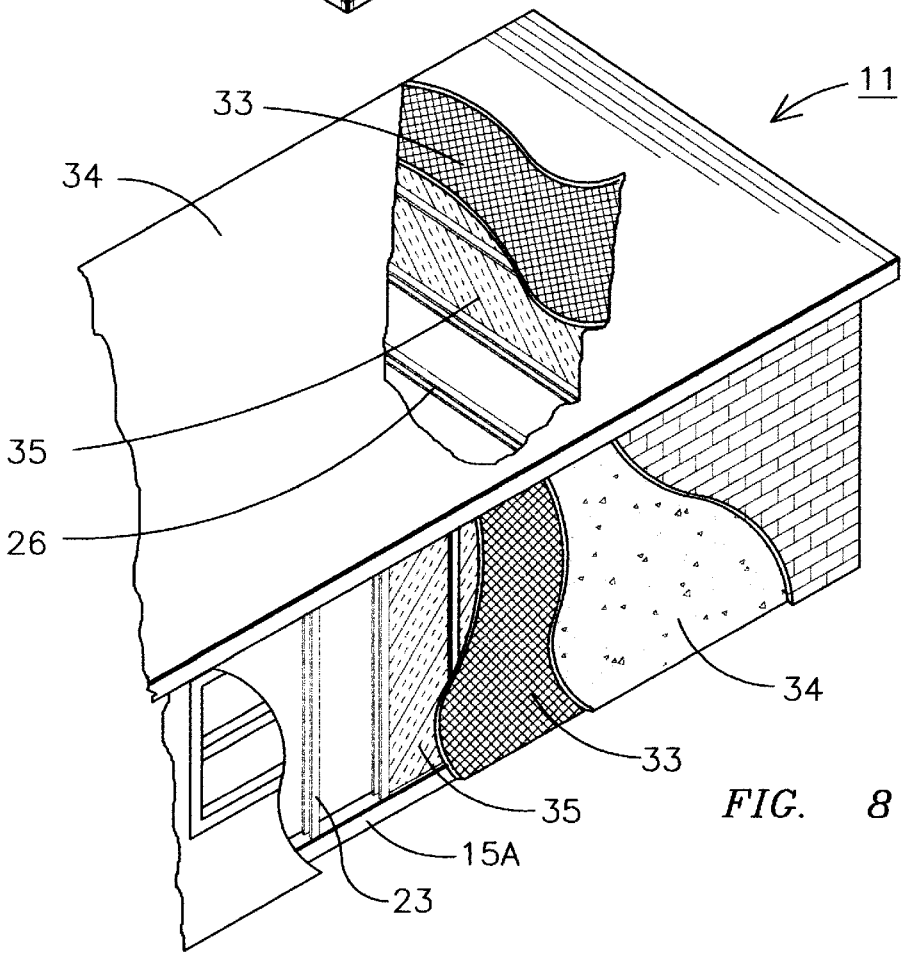
FIG. 8 is a expanded perspective of the building in FIG. 7.

The building frame is shown in FIG. 2. The floor of the building 11 includes a steel floor frame 15 having a concrete deck 18 disposed within the floor frame 15. The floor frame 15 includes the frame members 15A along the sidewalls 13, and floor frame members 15B along the end walls 12 forming a rectangular frame. As shown in FIG. 6, a metal corrugated floor decking 19 is disposed within the floor frame 15 and mounted therein on angle supports 20. A concrete slab 18 is poured over the metal decking 19, and is reinforced by rebar members mounted within the floor frame 15. A rigid polystyrene insulation 35 with an elastomeric coating is affixed to the bottom of the decking within the floor frame 15.

The wall frames 16 are generally constructed in the form of conventional wall frames. The wall frames 16 have vertically extending wall studs 23 mounted to the floor frame members 15A and 15B, spaced apart along respective side walls 13 and end walls 12. The wall studs 23 are fixed in place by welding a top end of each wall stud 23 to top mounting track 22, and welding a bottom end of each wall stud 23 to a bottom mounting track 21. The bottom track 21 is secured to each floor frame member 15A and 15B and extends coextensive therewith between the wall studs 20 and the floor frame members 15A and 15B. The wall studs are preferably spaced apart two feet along the floor frame members 15A and 15B.

The roof 14 of the building 11 is composed of a roof frame 17 similar in construction to the wall frames 16. In regard to FIG. 2, the roof frame 17 is illustrated mounted to the wall frames 16. The roof frame 17 includes the roof studs 32 spaced apart along the roof frame 17 and held in place by welding the two ends of each wall studs 23 to a mounting track 24, which are mounted on the wall frames 16 along the side walls 13. The pitch of the roof may vary according to the building specifications and codes, but generally the pitch is one-quarter inch to a foot. The pitch is created simply by constructing one side wall frame 16 higher than the other, and the roof frame 17 is mounted to the wall frames by methods known in the art.

As previously noted, the noncombustible building disclosed in this application is transportable. The building 11 incorporates within its frame a means for hitching the building 11 to a lifting means. This attachment means in a preferred embodiment takes the form of a lifting frame 25 shown in FIGS. 2 and 3. The lifting frame 25 includes four vertical columns 26. Two of the columns 26 are mounted on a floor frame member 15A and the other two columns 26 are mounted to the opposing floor frame member 15A along the other sidewall. The columns are positioned at the four corners of a rectangle.

A bottom end of each of the columns 26 is welded directly to a respective floor frame member 15A. Each of the columns 26 of the lifting frame 25 is positioned on a floor frame member 15A from an end of the floor frame member 15A a distance equal to one-quarter of the length of the floor frame member 15A. Thus the distance between the two columns on respective floor frame members 15A, measured from the center of the columns, is about one half of the total length of the frame member 15A to which the columns 26 are mounted. This placement of the columns 26 on the floor 15 provides an even distribution of the weight of the building 11 when being raised or lowered.

Figure 4:
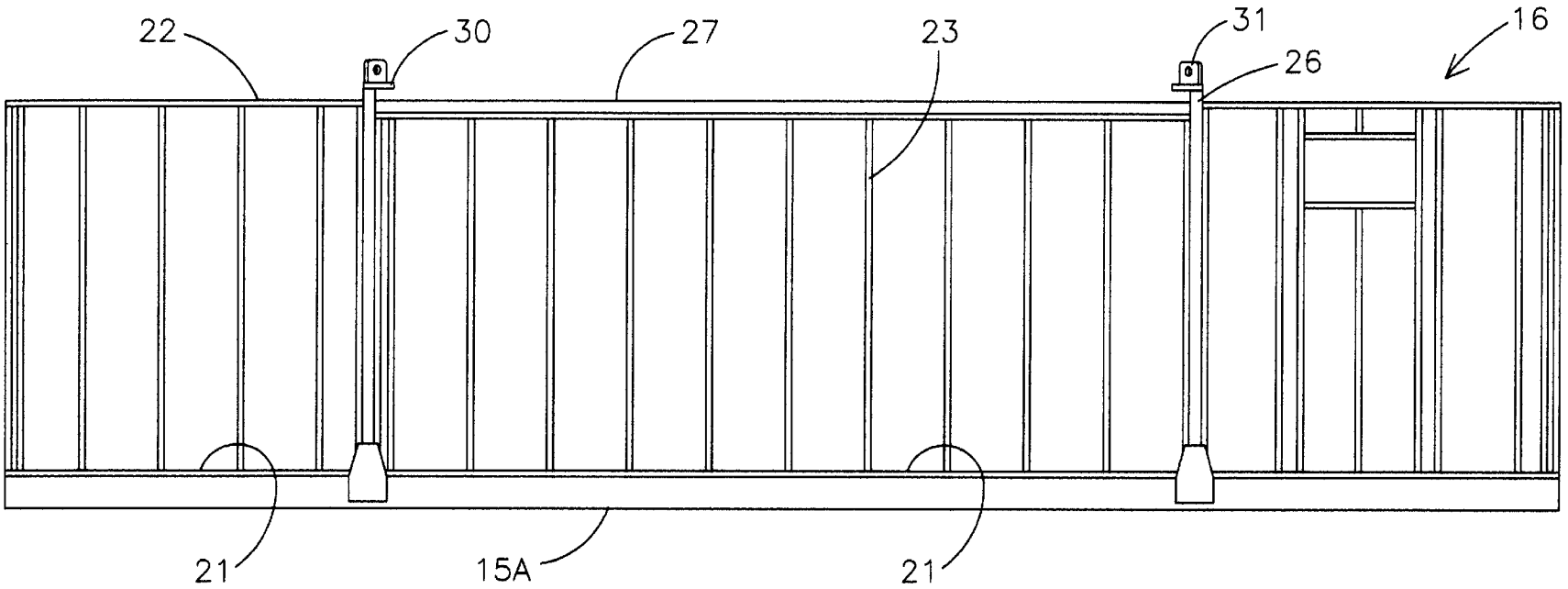
FIG. 4 is a side elevational view of the building frame of the noncombustible transportable building.

The lifting frame 25 is illustrated in a side elevational view in FIG. 4. In as much as the columns 26 are welded to the floor frame members 15A along the side walls 13, the wall frames 16 on the side walls 13 include three separate frames. A wall frame 16 is disposed on each end of the floor frame member 15A, and a wall frame 16 also is mounted on the floor frame member 15A between the columns 26.

The columns 26 are also supported together by structural members that are welded toward a top end of the columns 26. The structural members include horizontal members 27 mounted to the columns 26, and extending intermediate columns 26 above and parallel to the floor frame member 15A. The horizontal member 27 is mounted to the columns 26 at a predetermined height so the top surface of horizontal member 27 is positioned at the same height as the top surface of the top mounting rack 22 on the wall frames 16 as shown in FIG. 4. The wall frame 16 between the columns 26 extends vertically from the floor frame member 15A to the horizontal member 27, and is welded to the columns 26 and horizontal member 27 of the lifting frame 25. The columns 26 extend above the wall frames 16 and the horizontal member a sufficient height so the roof frame 17 may be mounted to the top of the wall frames 16.

Figure 3:
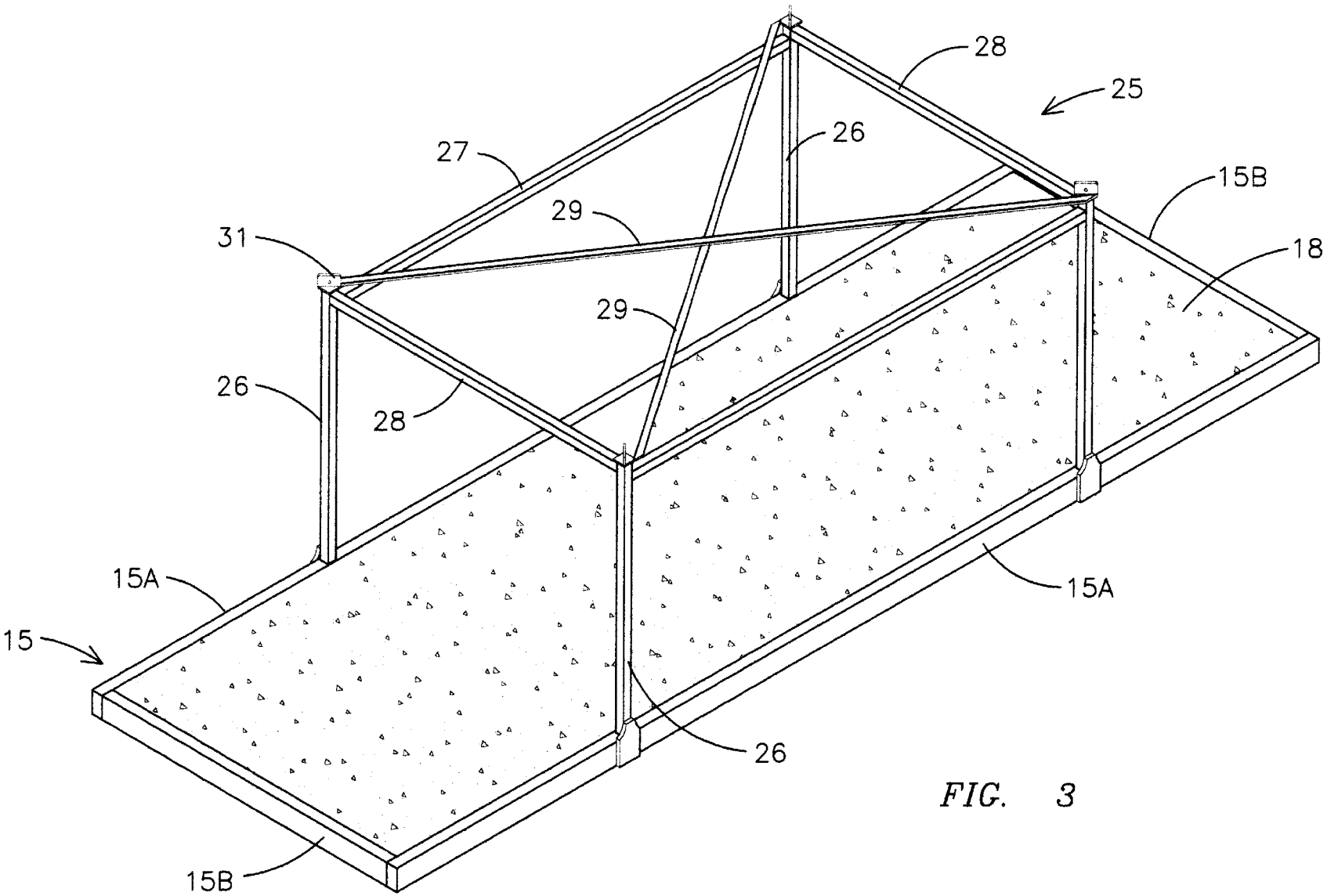
FIG. 3 is a perspective view of the lifting frame mounted to the floor frame.

With respect to FIG. 3, the lifting frame 25 also includes the cross members 28 and diagonal members 29. The cross members 28 extend between the columns 26 on floor frame members 15A of opposing side walls 13, substantially perpendicular to the horizontal members 27 on the lifting frame 25. The cross members 28 are mounted to the columns 26 at a point above the point of attachment of the horizontal members to the lifting frame. The top surface of the cross members 28 is coplanar with the top surface of roof stud 32.

In addition to the cross members 28, the lifting frame 25 has two diagonal members 29 extending diagonally between columns 26. A weldment plate 30 is mounted to the top of each of the columns 26. The weldment plate 30 has a bottom surface to which the diagonal members are welded; and, a lifting eye 31 is mounted to the top surface of the weldment plate 30.

Given that the lifting frame has the cross members 27 extending from one side wall 13 to the other, the roof frame 17 is constructed of three frames. A roof frame 17 is mounted to the wall frames 16, and the lifting frame 16, at each end of the building and a roof frame 16 extends from one side wall 13 to another between the columns 26. As shown in the sectional view in FIG. 5, the roof frame 17 is mounted on top of the wall frames 16.

Figure 5:
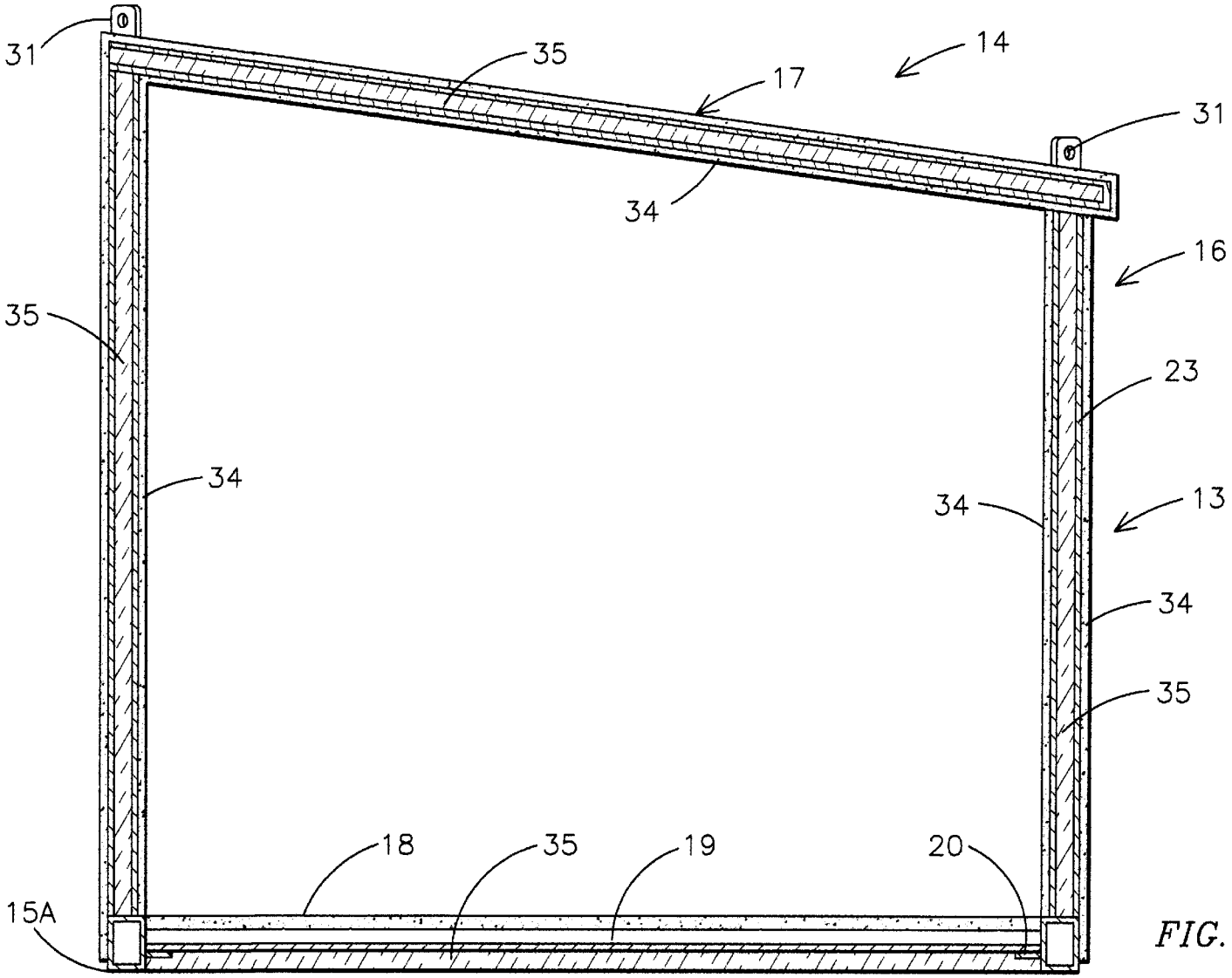
FIG. 5 is a sectional view of a building taken along line 5—5 and FIG. 1.

In regard to FIGS. 1 and 5, the building illustrated has been completed with the different layers of construction materials. A polystyrene insulation 35 is secured between consecutive wall studs 23 along the wall frames 16 and the consecutive roof studs 23 along the roof frame 17.

A frame support coating is applied to both the exterior and interior of the wall frames and roof frames, to enhance the overall structural integrity of the building. The support coasting includes a steel wire mesh 33, and a cement layer 34. A first layer of steel wire mesh 33 fastened against the exterior of the wall frames 16 and the roof frames 17 and insulation 35. A second layer of the mesh netting 33 is fastened against the interior of the wall frames 16, roof frame 17 and insulation 35 encasing the entire building frame system within the mesh, and securing the insulation 35 within the building frame. The mesh should have sufficient stencil strength to serve as a structural component of the building frame. For example, a one inch mesh of 16 gauge strength has been found adequate for building construction purposes.

The mesh 33 also serves as a means for affixing a cement layer 34 to the wall frames 16 and roof frames 18. After the mesh is fastened to the wall frames 16 and roof frames 17, a layer of cement 34 is applied to both the exterior and interior of the wall frames 16 and the roof frames 17. The layer of cement 34 is preferably ⅞ inches thick. The cement composition is known in the art, but is preferably mixed to provide a 4000 psi compression strength. The cement 34 is also finished with a desirable texture, then sealed and painted on the interior and exterior of the building. The application of the cement layer 34 in conjunction with the steel wire mesh affixed to the building enhances the overall structural integrity of the building.

When the construction of the building is completed the lifting eyes 31 on the lifting frame extend above the exterior surface of the roof for attachment to a lifting means. A crane is operated to lift the building on a transport vehicle capable of withstanding such a load. Once at the construction site, the building is lowered to a foundation which is preferably constructed of concrete pads buried in the ground. The pads are arranged in a rectangular configuration and spaced apart on the ground. Each concrete pad has a welding plate embedded therein that is slightly exposed on the top surface of the pad. The floor frame members 15A and 15B contact the welding plates on the pads, and are welded thereon securing the building in place.

In FIGS. 7 through 10, a second embodiment of the invention is depicted in the form of two modules 40A and 40B being joined together to form a building. In this embodiment the modules are constructed having two end walls 41 and only a single side wall 42. Modules 40A and 40B do not have a side wall along the junction of the two modules. The lifting frame has a temporary column extending from the floor frame member 15A to the horizontal frame member 27 on the lifting frame. The means for temporarily mounting the column on the building frame may vary in construction, but it is sufficient only to connect to lifting eyes 31 to the floor frame members 15A via a vertical member 37.

An extension 36 depends from the lifting eye 31 on the lifting frame 25. An angle member 37 is then mounted to the extension by a bolting means, and extends vertically to the floor frame member 15 where it is welded. When the modules are in place for joining, the angle member 37 is unbolted from the extension 36 and out from the floor frame member 15A.

Figure 9:
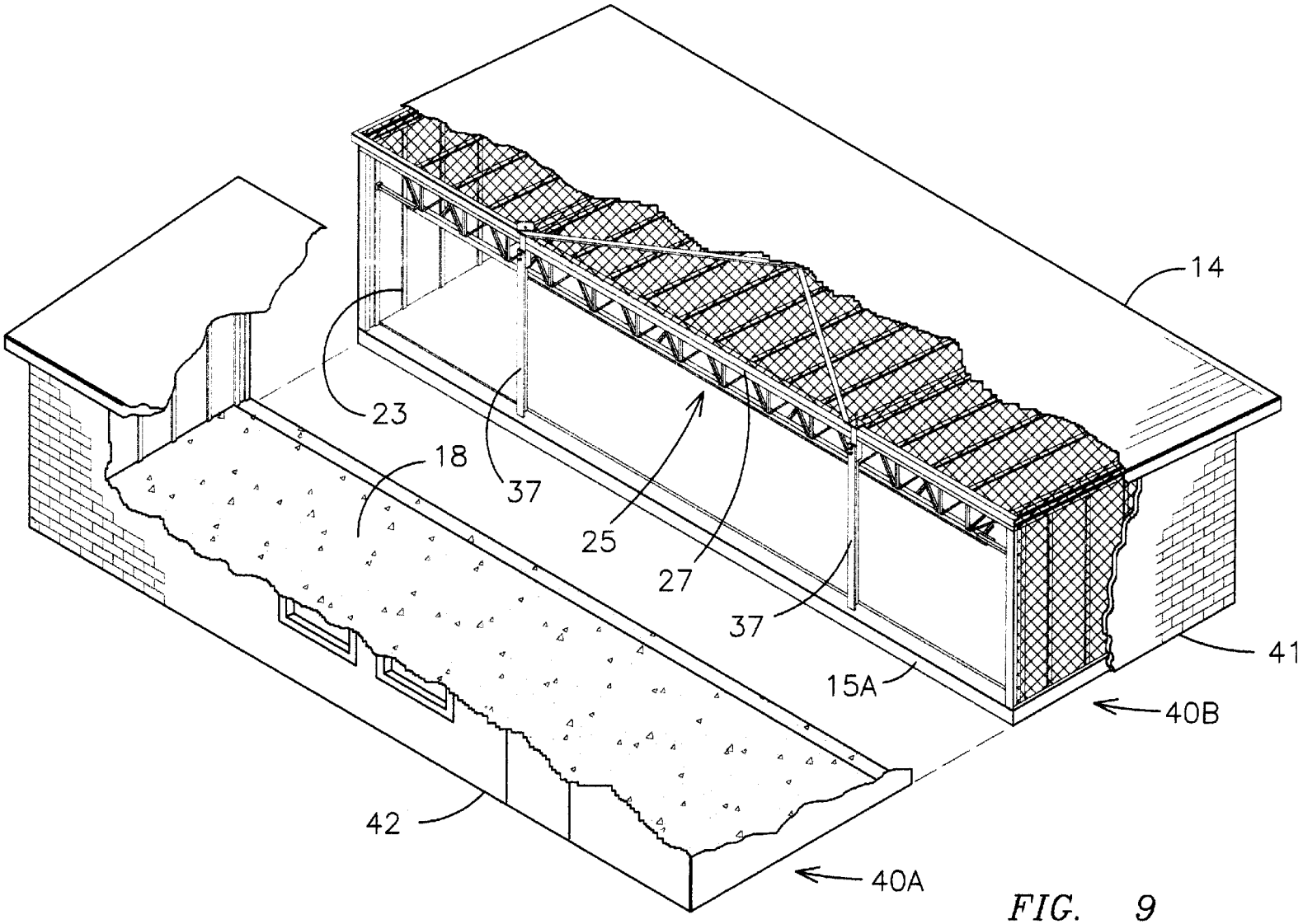
FIG. 9 is an expanded perspective view of two modules separated.
Figure 10:
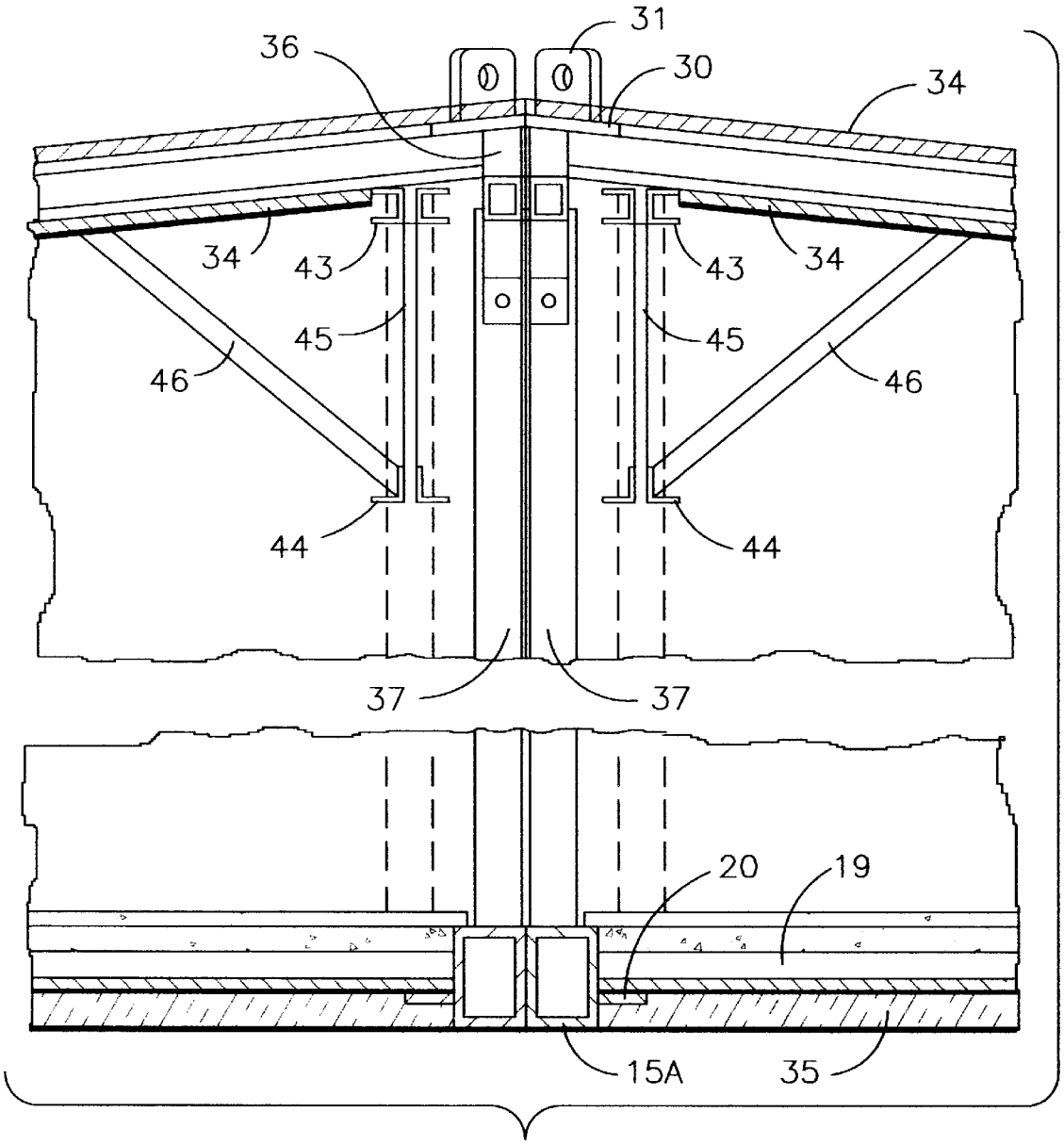
FIG. 10 is sectional view of two modules of the noncombustible transportable building.

In as much as the vertical members 37 are removed from the lifting frame, the horizontal member 27 is not capable of supporting the roof frame 17 of the building. As shown in FIGS. 9 and 10, a bar joist system is mounted to the wall frames and roof frame and extends the length of the building, from one end wall 41 to the other end wall. The bar joist includes and upper joist 43 and a lower joist 44 connected by brace member 45. A lateral brace 44 fixes the lower joist bar 43 to the roof frame 17. The roof frame 17 is mounted directly to the upper joist 44. The bar joist system is spaced inward from the edge of the roof frame about six inches. In addition, an acoustical ceiling is suspended from the roof frame concealing the roof structure and lifting frame structures.

Once the modules are secured in place on the concrete pads as previously described, and the temporary column of the lifting frame is removed, the floor frame members 15A of the different modules are welded together. In addition, the adjacent floor frame members, wall frame members, and roof frame members on the respective modules are welded together coupling together the adjacent modules. A filler is applied to the floor of the building along the junction of the buildings so the floor surface is a smooth continuous surface.

While I have disclosed the preferred embodiment of my invention, it is not intended that this description in any way limits the invention, but rather this invention should be limited only by a reasonable interpretation of the new recited claims.

Having thus described my invention, what I claim as new and desire to secure by Letter Patent is:

1. A noncombustible transportable modular building, capable of being lifted and moved by a lifting means, comprising;

(a) a floor structure having a floor frame including a plurality of steel floor frame members welded together to form a substantially rectangular floor frame, and a layer of concrete disposed within said floor flame members and secured therein;

(b) a plurality of walls including a plurality of wall frames mounted to the floor structure extending vertically therefrom, and a roof including a roof frame secured to the wall frames, said wall frames and said roof frame having a plurality of steel stud members spaced apart along said respective roof frame and said wall frames, and insulation means secured between consecutive wall studs along the wall frames and the roof frame;

(c) a first layer of cement applied to each of the wall frames and the roof frame along an exterior surface of the wall frame, roof frames and insulation, and a second layer of cement applied to an interior surface of said wall frames, the roof frames and the insulation;

(d) means, fastened to said wall frames, roof frame and insulation, along the interior surface and exterior surface thereof, for securing said first and second cement layer to said building; and (e) means, having a bottom end mounted to the floor flame and extending generally vertically therefrom, and a top end extending through the roof of the building above an exterior surface of the roof of the building, for providing attachment for lifting said building.

2. A transportable noncombustible building as defined in claim 1 wherein said plurality of steel floor frame members includes two side floor frame members spaced apart and parallel to one another, and two end floor frame members spaced apart and parallel to one another and welded to the side floor frame members forming said rectangular floor frame, and said means for providing attachment for lifting said building includes a lifting frame having four vertically extending columns, and two of said columns mounted on a first side floor frame member and the other two columns mounted on the second side floor frame member, and said columns extending parallel to the wall studs on the wall frame mounted on said side floor frame members, each said column having a lifting eye mounted on a top end thereof, and said columns positioned on the floor frame for even distribution of the weight of the building when lowered and raised attachment of said lifting means to said lifting eyes.

3. A transportable non-combustible building as defined in claim 2 wherein said lifting frame includes horizontal members mounted to said columns on the first side frame member, extending intermediate said columns and spaced above said first side frame member, and cross members extending intermediate columns on the first side floor member and the second side floor member perpendicular to said horizontal members, and mounted said columns at a point above a point of attachment of the horizontal members to the columns, and said cross members extending parallel to the roof studs within said roof frame, and diagonal members extending diagonally intermediate the columns on said first side floor member and columns on the second side floor member.

4. A noncombustible transportable building as defined in claim 1 wherein said means for securing the cement to the building includes a steel mesh fastened to an exterior surface and interior of the wall frame, roof frame and insulation, said steel mesh covering the spacing between consecutive wall studs and roof studs.

5. A transportable noncombustible building as defined in claim 4 wherein said plurality of steel floor frame members includes two side floor frame members spaced apart and parallel to one another, and two end floor frame members spaced apart and parallel to one another and welded to the side floor frame members forming said rectangular floor frame, and said means for providing attachment for lifting said building includes a lifting frame having four vertically extending columns, and two of said columns mounted on a first side floor frame member and the other two columns mounted on the second side floor frame member, and said columns extending parallel to the wall studs on the wall frame mounted on said side floor frame members, each said column having a lifting eye mounted on a top end thereof for engagement with said lifting means, and said columns positioned on the floor frame for even distribution of the weight of the building when lowered and raised by attachment of the lifting means to said lifting eyes.

6. A noncombustible transportable building as defined in claim 5 wherein said lifting frame includes a horizontal member mounted to said columns on the first side frame member, extending intermediate said columns and spaced above said first side frame member, and cross members extending intermediate columns on the first side floor member and the second side floor member perpendicular to said horizontal members, and mounted said columns at a point above a point of attachment of the horizontal members to the columns, and said cross members extending parallel to the roof studs within said roof frame, and diagonal members extending diagonally intermediate the columns on said first side floor member and columns on the second side floor member.

7. A noncombustible transportable modular building, comprising:

(a) a floor structure having a steel floor frame including two side frame members spaced apart and parallel to one another, and two end frame members spaced apart and parallel to one another, said floor frame members welded together forming a substantially rectangular floor frame, said floor structure further including a concrete floor disposed within the floor frame members;

(b) two side wall frames mounted to said floor frame, each said side wall frame mounted to a corresponding side floor frame member and including a plurality of wall studs having a lower end mounted to a respective side floor frame member and extending vertically therefrom;

(c) two end wall frames mounted to said end floor frame member, each said end wall frame including a plurality of wall studs having a lower end mounted to a respective end floor frame member and extending vertically therefrom;

(d) a roof frame mounted to an upper end of said side wall frames and said end wall frames, said roof frame including a plurality of spaced apart, and parallel, roof studs extending from one side wall frame to the other side wall frame and spaced apart along said roof frame;

(e) an insulating means disposed between consecutive wall studs on the end wall frames and the side wall frames, and disposed between consecutive roof studs on the roof frame;

(f) means, coupled with said building frame, for attachment of a building lifting means for raising and lowering the building for transportation of said building; and, (g) a building frame support coating affixed to the interior and exterior of the building including a steel wire meshing fastened to the wall frames, roof frame and insulation and extending across the space between consecutive studs on the roof frame and wall frames and encasing the wall frames, roof frame and insulation within said wire meshing, and a layer of cement from a cement mixture tested for a predetermined compression strength, and applied to an exterior surface of the wall frames, roof frames, and a second layer of cement applied to an interior surface of the wall frames, roof frame.

8. A noncombustible transportable building, comprising:

(a) a first and second building module coupled together along a building frame of each said module, said first and second building module each having a building frame including a floor structure having a steel floor frame including two side frame members spaced apart and parallel to one another, and two end frame members spaced apart and parallel to one another, said floor frame members welded together forming a substantially rectangular floor frame, said floor structure further including a concrete floor disposed within the floor frame members, where said modules are joined by weldment of a side floor frame member on the first module to a side floor frame member on the second module;

(b) a side wall frame mounted to said side floor frame member on the first module that is extending parallel the side floor frame member welded to the floor frame on the second module, and said second module having a side wall frame mounted on a side floor frame member opposite said side floor member welded to the floor frame of the first module;

(c) two end wall frames, mounted on said floor frame of said first module, each said end wall frame including a plurality of wall studs having a lower end mounted to a respective end floor frame member and extending vertically therefrom, each said end wall frame on the first module welded to a respective end wall frame on the second module;

(d) a roof frame mounted to an upper end of said side wall frame and said end wall frames on said first module, said roof frame including a plurality of spaced apart, and parallel, roof studs extending from said side wall frame to a roof joist system on said first module, and spaced apart along said roof frame, and a roof frame mounted to an upper end of said side wall frame and said end wall frames on said second module, said roof frame including a plurality of spaced apart, and parallel, roof studs extending from said side wall frame to a joist system on said second side wall whereby said roof frame on said first module is welded to said roof frame on the second module;

(e) an insulating means disposed between consecutive wall studs on the end wall frames and the side wall frames, and disposed between consecutive roof studs on the roof frame;

(f) means, having a bottom end mounted to the floor frame and extending generally vertically therefrom, and a top end extending through the roof of the building above an exterior surface of the roof of the building, for hitching said building to a lifting means, and said lifting means attached to the top end of said hitching means; and, (g) a building frame support coating affixed to the interior and exterior of the building including a steel wire meshing fastened to the wall frames, roof frame and insulation and extending across the space between consecutive studs on the roof frame and wall frames and encasing the wall frames, roof frame and insulation within said wire meshing, and a cement coating, taken from a cement mixture tested for a predetermined compression strength, and applied to an exterior surface of the wall frames, roof frames, and a second layer of cement applied to an interior surface of the wall frames, roof frame.

* * * * *